US009322145B2

(12) United States Patent
Nilsson et al.

(10) Patent No.: US 9,322,145 B2
(45) Date of Patent: Apr. 26, 2016

(54) QUICK COUPLER FOR AN EARTH MOVING MACHINE

(75) Inventors: Markus Nilsson, Solientuna (SE); Stefan Stockhaus, Danderyd (SE); Sven Siggstedt, Norrtalje (SE)

(73) Assignee: STEEL WRIST AB, Sollentuna (SE)

( * ) Notice: Subject to any disclaimer, the term of this patent is extended or adjusted under 35 U.S.C. 154(b) by 204 days.

(21) Appl. No.: 14/004,675

(22) PCT Filed: Feb. 28, 2012

(86) PCT No.: PCT/SE2012/050223

§ 371 (c)(1),
(2), (4) Date: Nov. 15, 2013

(87) PCT Pub. No.: WO2012/125104

PCT Pub. Date: Sep. 20, 2012

(65) Prior Publication Data

US 2014/0064824 A1 Mar. 6, 2014

(30) Foreign Application Priority Data

Mar. 17, 2011 (SE) ..... 1150240

(51) Int. Cl.
*B25G 3/18* (2006.01)
*E02F 3/36* (2006.01)
*E02F 9/26* (2006.01)

(52) U.S. Cl.
CPC ..... *E02F 3/3663* (2013.01); *E02F 3/3627* (2013.01); *E02F 9/26* (2013.01); *Y10T 403/20* (2015.01); *Y10T 403/591* (2015.01); *Y10T 403/593* (2015.01)

(58) Field of Classification Search
CPC ..... E02F 3/3627; E02F 3/3663; E02F 9/26; E02F 3/365; E02F 3/3668; Y10T 403/20; Y10T 403/593; Y10T 403/591
USPC ..... 37/468, 906; 172/272; 414/723
See application file for complete search history.

(56) References Cited

U.S. PATENT DOCUMENTS 4,311,428 A * 1/1982 Arnold ..... 414/723
5,010,962 A 4/1991 Bloom (Continued)

FOREIGN PATENT DOCUMENTS

AU 2009201972 A1 11/2009
WO 0177447 A1 10/2001
WO 02097201 A1 12/2002

OTHER PUBLICATIONS

International Search Report from corresponding International Application No. PCT/SE2012/050223, dated May 30, 2012.

*Primary Examiner* — Michael P Ferguson
*Assistant Examiner* — Matthew R McMahon
(74) *Attorney, Agent, or Firm* — Renner, Otto, Boisselle & Sklar, LLP

(57) ABSTRACT

Quick coupler (1) for attaching a tool (2), comprising an attachment bracket with two parallel attachment pins (3*a*, 3*b*), to an earth moving vehicle. The quick coupler (1) comprises a frame (4) with a first cutout (5) and a second cutout (6) arranged substantially perpendicular to each other, where the respective cutout is adapted to cooperate with the respective attachment pin (3*a*, 3*b*) of the tool (2). The quick coupler (1) further comprises at least one, in relation to the frame (4) moveable locking arrangement (9), adapted to delimit the second cutout (6) in a direction parallel to the first cutout (5), at least one, in the frame (4) arranged, actuator (8) adapted to move the locking arrangement (9) between a first open and a second locked position, and a lock indication device (10) which visually indicates if the locking part (9) is in the first or second position. The at least one actuator (8) is attached between the locking arrangement (9) and the lock indication device (10) and is arranged to move both the locking arrangement (9) and the lock indication device (10) in relation to the frame (4) so that the lock indication device (10) visually indicates when the locking arrangement (9) is in the second locked position by a protrusion of the lock indication device (10) from the frame (4) which therefore makes it visible from outside the frame (4).

8 Claims, 4 Drawing Sheets

(56) References Cited

U.S. PATENT DOCUMENTS

| | | | | |
|---|---|---|---|---|
| 5,562,397 | A * | 10/1996 | Albright | 414/723 |
| 5,692,855 | A | 12/1997 | Burton | |
| 6,132,130 | A | 10/2000 | McCann | |
| 6,254,331 | B1 | 7/2001 | Pisco | |
| 6,379,075 | B1 | 4/2002 | Shamblin | |
| 6,508,616 | B2 * | 1/2003 | Hung | 414/723 |
| 6,699,001 | B2 * | 3/2004 | Fatemi | 414/723 |
| 6,902,346 | B2 * | 6/2005 | Steig et al. | 403/322.3 |
| 7,086,821 | B1 * | 8/2006 | Reicks | 414/723 |
| 7,984,575 | B2 * | 7/2011 | Robl et al. | 37/468 |
| 8,262,310 | B2 * | 9/2012 | Sikorski et al. | 403/322.3 |
| 8,556,534 | B2 * | 10/2013 | Lim et al. | 403/322.3 |
| 8,678,697 | B2 * | 3/2014 | Monaghan et al. | 403/322.3 |
| 2007/0166143 | A1 * | 7/2007 | Hart et al. | 414/723 |
| 2009/0282712 | A1 * | 11/2009 | Pruszynski | 37/468 |
| 2010/0189535 | A1 | 7/2010 | Nye | |
| 2014/0341648 | A1 * | 11/2014 | Nilsson et al. | 403/376 |

* cited by examiner

QUICK COUPLER FOR AN EARTH MOVING MACHINE

TECHNICAL FIELD

The present invention relates generally to a quick coupler used for attaching a tool to an earth moving vehicle, where the quick coupler comprises a locking device and a locking indication device.

BACKGROUND ART

Today it is very common that quick couplers are used for connecting different tools to an earth moving machine, for example an excavator, backhoe loader or a digger. With the quick coupler the driver can quickly and simply switch between different tools, for example different buckets, which can be used for s certain work condition. The quick coupling is mounted directly on the excavator art or on a on the arm mounted tilt rotator which allow tool movement in all directions. It can also be integrated in the tilt rotator. The quick coupling has in its lower part a locking mechanism adapted to lock the tool, either mechanically or with a hydraulically controlled lock. The locking mechanism often comprises a solid grip and a locking wedge or locking pins which locks the tool around parallel axles attached to the attachment bracket.

Quick couplers can be divided into two groups; universal or dedicated. Universal quick couplers are characterized in that the quick coupler is constructed to be able to be used on tools originating from different tool manufactures. Since the tools originate from different tool manufacturers or different excavator models, the distance between the parallel axles can vary and the diameter of the axles can be different. Thus, a universal quick coupler normally fits tools with different distances between the axles and sometimes also fit tools with different axle diameter. Dedicated quick couplers are, on the other hand, based on a standard, which result in that the quick coupler only fits if the tool follows the standard from which the quick coupler is constructed. Only the upper part, i.e. the part mounted adjacent the excavator arm, varies while the locking mechanism follows a standard. The most common standard for quick couplers on the Nordic market is symmetrical quick couplers, which are based on a gate with two parallel axles.

A problem with quick couplers of today is that the lock indication often is indistinct and not always secure. Today normally an indicator rod/indicator pin is used which is connected to the locking arrangement of the quick coupler. This means that when the locking arrangement is retracted into the holder the lock is opened and the indicator rod becomes visible, which indicates that the lock is open. Such solutions are for example disclosed in WO02097201A1 , U.S. Pat. No. 6,379,075B1 and U.S. Pat. No. 6,132,130A. Thus, the normal is that the quick coupler has a negative lock indication, i.e. it indicates when the lock is open. The risk with this solution is, if the indicator rod in either way is broken or removed the driver may believe that the lock is closed, since no indicator rod is visible, while it actually is open. In such case the risk is large that the tool is dropped, which can be dangerous for personnel working in the vicinity of the excavator.

Other locking arrangements are also know which makes it possible to indicate when the lock is locked. Such quick coupler lock indication arrangements are for example shown in US20100189535A1, EP0527733B1 and U.S. Pat. No. 5,692,855A.

In both US20100189535A1 and EP0527733B1 a locking arrangement is disclosed having the shape of a, in relation to the quick coupler, laterally extending hydraulically actuated pin, which both see to that the lock remains locked and which, with a colored outer part visible for the driver, indicates that this is the case. U.S. Pat. No. 5,692,855A shows a coupling arrangement where a handle visible for the observer is turned together with the locking arrangement and indicates locked and unlocked position, respectively.

These solutions either demand an extra hydraulic actuator and/or several mechanically connected components which can be loose or break. Thus, there is a need for a simple and reliable lock indicator for a quick coupler which clearly indicated for that driver that the tool is securely locked to the excavator.

SUMMARY OF INVENTION

An object of the present invention is to in a simple and clear way indicate when a quick coupler of an earth moving vehicle, for example an excavator, is locked.

The invention relates to a quick coupler for attaching a tool, comprising an attachment bracket with two parallel attachment pins, to an earth moving vehicle. The quick coupler comprises a frame with a first cut-out and a second cut-out arranged substantially perpendicular to each other, where the respective cut-out is adapted to cooperate with the respective attachment pin of the tool. The quick coupler also comprises at least one, in relation to the frame moveable locking arrangement, adapted to delimit the second cut-out in a direction parallel to the first cut-out, at least one, in the frame arranged, actuator adapted to move the locking arrangement between a first open and a second locked position and a lock indication device which visually indicates if the locking part is in the first or the second position. The invention is characterized in the at least one actuator is attached between the locking arrangement and the lock indication device in relation to the frame so that the lock indication device visually indicated when the locking arrangement is in the second locked position.

By arranging the at least one actuator between the locking arrangement and the lock indication device, a simple and reliable construction is created where the lock indication clearly shows in which position the locking arrangement is located. When the locking arrangement is in a first locked position, the lock indication is also in such a position that it can be spotted from the outside. An observer can see and verify that the lock is locked. Thus, the risk of unintentionally dropping a tool is decreased. The actuator is a mechanical arrangement controlling movements of the locking arrangement and the lock indication device. It can be electrically, hydraulically or mechanically actuated. For example, it can be an electrically operated engine, a hydraulic cylinder or a compressed spring pre-loaded by an outer force.

In one embodiment the locking arrangement and the lock indication device are arranged to move substantially simultaneously in opposite directions.

By letting the locking arrangement and the lock indication device to extend in a direction away from the frame on each side of the frame, there is no risk that the respective parts hide each other.

In another embodiment, the locking arrangement and the lock indication device are adapted to be moved in a direction substantially parallel to the extension direction of the first cut-out.

A parallel movement of the locking arrangement and the lock indication device creates a force acting straight on the actuator. If a hydraulic cylinder is used it is possible to use its entire stroke and an uneven load on the piston shaft can be avoided.

In one embodiment the lock indication device comprises at least one elongated indication part with a first distal end and a second proximal end, where the indication part is arranged to run in an opening in the frame so that it in the first position is inserted in the frame and in the second position protrudes from the frame and becomes visible from outside the frame.

To indicate when the lock indication device is in a first or a second position by using an elongated indication part is a reliable mechanical solution. Of course it is also possible to use other type of indication devices. For example can the actuator press against and create contact in an electric switch transmitting a sound and/or light signal when the locking cylinder is a locked position.

In one embodiment, the first distal end of the at least one indication part has a color differing from the color of the frame.

Painting the indication part makes it easier for the observer to see its position.

In one embodiment, two, with each other connected, cylindrical indication parts are arranged to run parallel in two openings in the frame.

If two cylinders are used to indicate if the lock is locked or open a better/more secure display is achieved, especially when the observer is standing in a direction across from the side or directly under the tool and quick coupler. Furthermore, a cylindrical shape is easy to seal off, thus the volume inside the frame in which the actuator is arranged, can be protected from dirt and moisture. This prolongs the life of the actuator.

In another embodiment the locking arrangement comprises at least one elongated locking part with a first distal end and a second proximal end wherein the locking part is arranged to run in an opening in the frame so that it in the first position is inserted in the frame and in the second position protrudes from the frame and delimit the second cut-out in a direction parallel with the first cut-out. The at least one elongated locking part can in one embodiment be in the shape of a cylinder.

To use an elongated locking part which runs through the frame and delimits the second cut-out is a simple and reliable mechanical locking construction. A cylindrical part provides an easily sealable construction, but it is also possible to have other shapes on the locking part.

In another embodiment is two cylindrical locking parts arranged to run parallel in two openings in the frame.

Two parallel locking cylinders provide for an even load on the actuator. If the locking cylinders are placed spaced apart, the locking effect in relation to the attachment axle of the tool is increased since two force application points are created.

In one embodiment the locking part has a chamfer in its first distal end which is adapted to the shape of the attachment pin of the tool which is adapted to cooperate with the second cut-out.

This gives the locking part a better contact surface against the attachment pin and a more play free lock.

All above described embodiment or part of an embodiment can be combined freely, as long as the combination is not contradictory.

BRIEF DESCRIPTION OF DRAWINGS

The invention is now described, by way of example, with reference to the accompanying drawings, in which.

DESCRIPTION OF EMBODIMENTS

In the following, it is provided a detailed description of embodiments of a quick coupler with the lock indication according to the invention. All examples shall be considered to be parts of the general description and is therefore generally possible to combine, unless they are contradictory.

Figure 1:
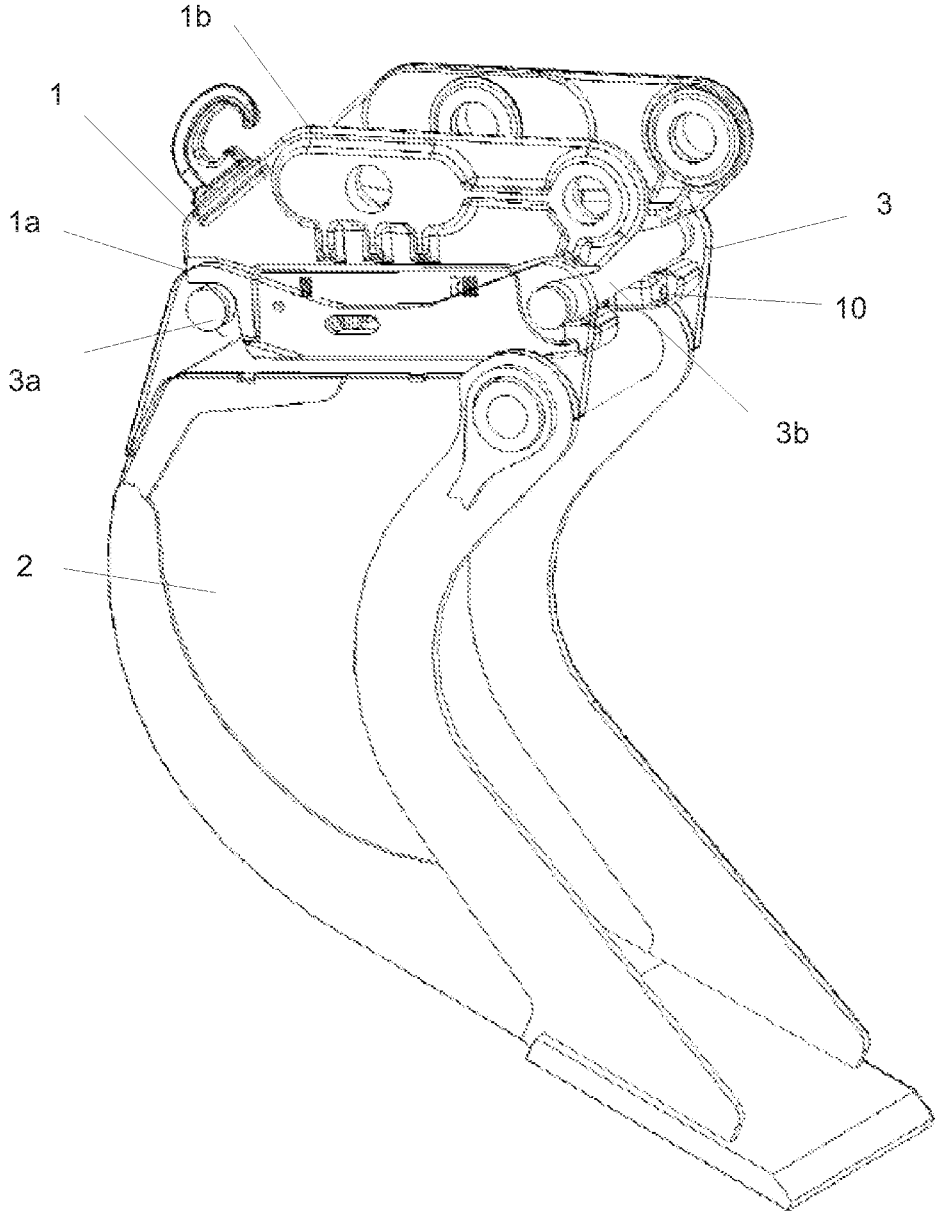
FIG. 1 shows a quick coupler attached to a tool.

FIG. 1 shows a quick coupler 1 attached in its lower part 1*a* in a tool 2, in this case a bucket. The quick coupler 1 is attached to the tool by means of an attachment bracket 3, which is a frame comprising two parallel attachment pins 3*a*, 3*b* which extend in a direction essentially parallel to both tool 2 and quick coupler 1. The upper part 1*b* of the quick coupler can be directly attached to an arm of an earth moving machine, for example an excavator, digger or any other machine adapted to perform earth moving operations. The quick coupler 1 can also be mounted by or integrated in a, on the arm mounted, tilt rotator which permits tool movement in all directions (not disclosed).

Figure 2A:
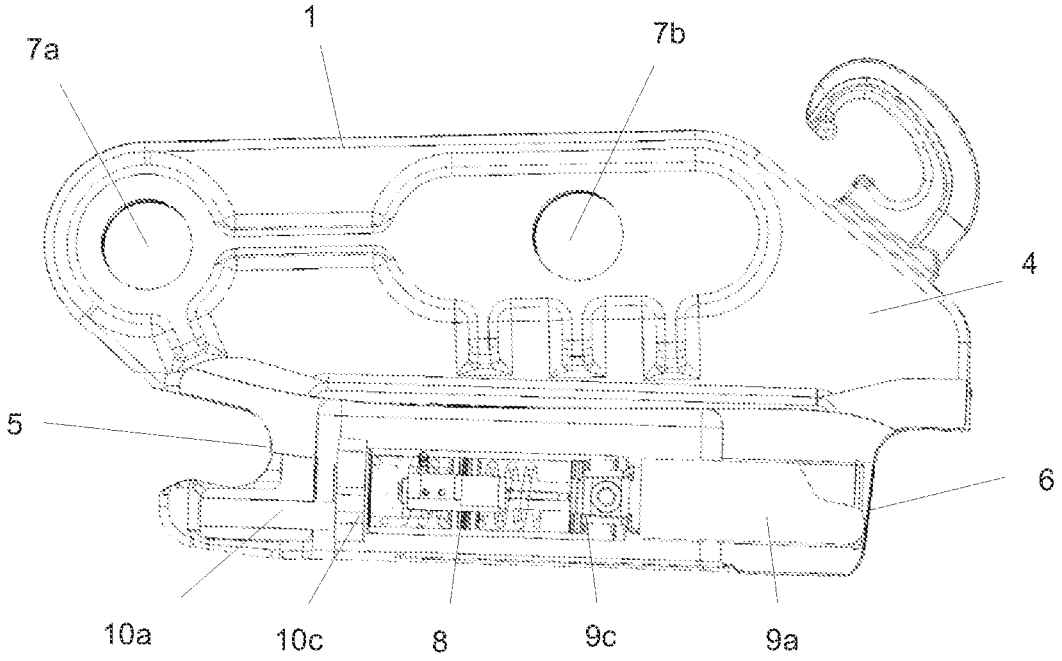
FIG. 2*a* shows a first vertical view of a quick coupler in an open position.
Figure 2B:
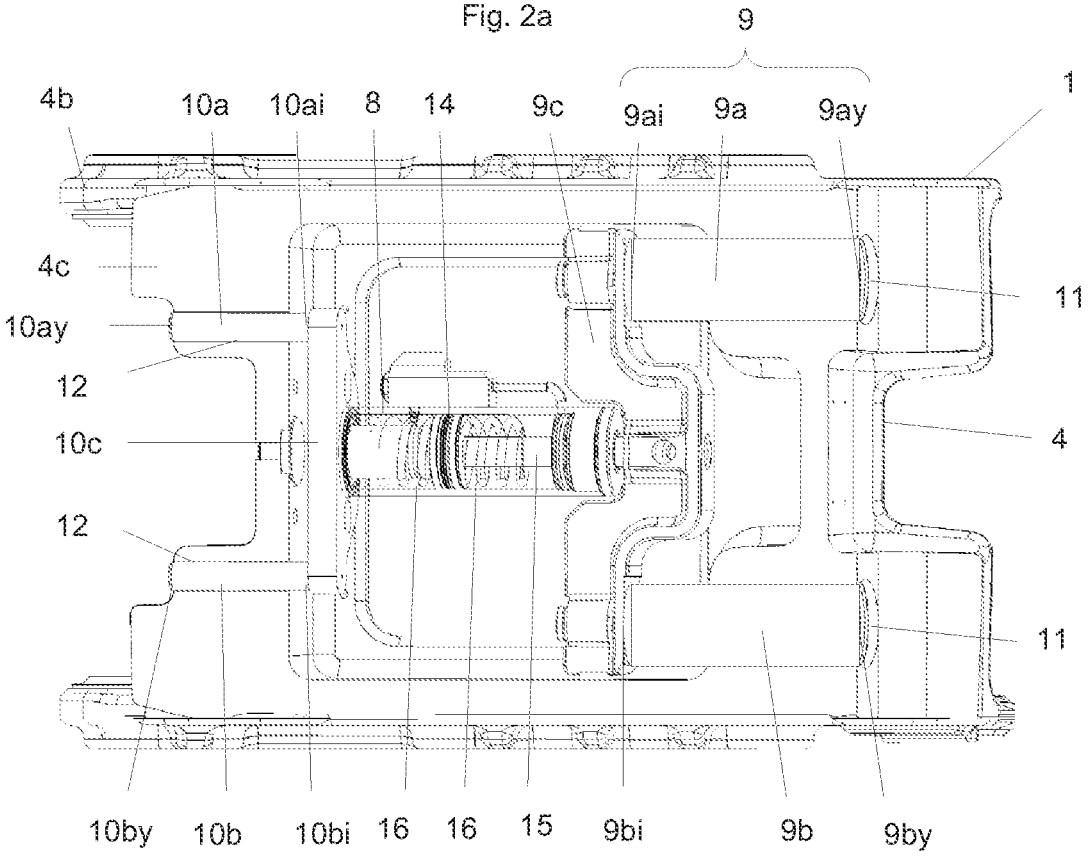
FIG. 2*b* shows a second horizontal view of a quick coupler in an open position.
Figure 3A:
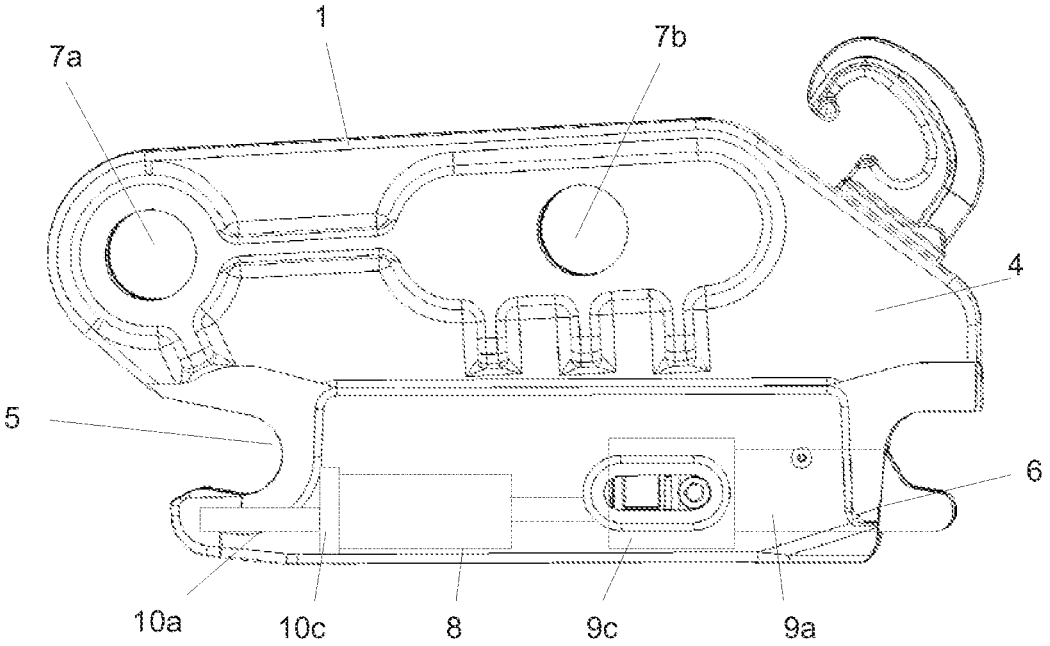
FIG. 3*a* shows a first vertical view of a quick coupler in a closed position.

FIGS. 2*a* and 2*b* shows detail views of the quick coupler when it is in an open position, i.e. when no tool is attached. FIG. 2*a* shows a side view of the coupler and FIG. 2*b* a plan view of the coupler. The side view can be said to be a vertical view and the plan view a horizontal view, when the coupler is so arranged in space that the lower edge 1*a* of the coupler is arranged essentially horizontal to the ground. Since the quick coupler, especially if attached to a tilt rotator, can rotate around several axles, this position is only one out of several possible positions. Thus, when the expressions horizontal and vertical are used, reference is only made to FIGS. 2*a* and 3*a*.

Figure 3B:
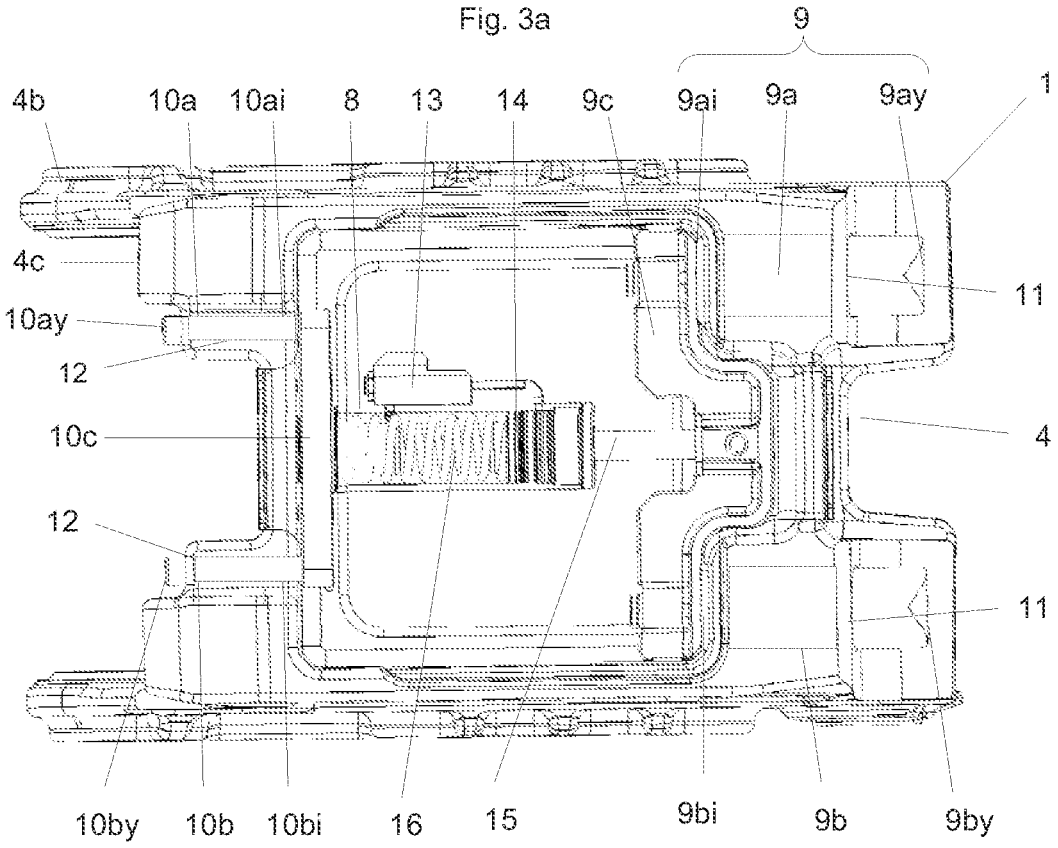
FIG. 3*b* shows a second horizontal view of a quick coupler in a closed position.

The quick coupler 1 in FIGS. 2*a*, 2*b* and FIGS. 3*a*, 3*b* comprises an essentially rectangular frame 4 with two lateral portions 4*a*, 4*b* connected with each other by a frame body 4*c* (see FIG. 2*b*, 3*b*). The two lateral portions 4*a*, 4*b* have a first and a second cut-out 5, 6 arranged essentially perpendicular to each other, i.e. the first cut-out 5 is in the figure essentially horizontal and the second cut-out 6 is essentially vertical. The cut-outs 5, 6 are adapted to cooperate with the attachments pins 3*a*, 3*b* of the tool by means of the first attachment pin 3*a* is inserted in the first horizontal cut-out 5 and the second attachment pin 3*b* cooperates with and rests in the second vertical cut-out 65 (see also FIG. 1). The attachment to the arm of the earth moving machine or the tilt rotator can be made through two holes 7*a*, 7*b* arranged in the lateral portions 4*a*, 4*b*.

In the rectangular frame 4 at least one actuator is arranged. In this embodiment the actuator 8 is a hydraulic cylinder, but it can also be an electrically operated engine, a compressed spring or another mechanical control arrangement. The actuator 8 is attached between a locking arrangement 9 and a lock indication device 10 and is arranged to linearly move both the locking arrangement 9 and the lock indication device 10 in relation to the frame 4. Since the actuator 8 is placed between the locking arrangement and the lock indication device 10, the locking arrangement 9 and the lock indication device 10 move essentially simultaneously in opposite directions. In the embodiment according to FIG. 1-3 the locking arrangement 9 and the lock indication device are moved essentially parallel to the elongation direction of the first cut-out 5.

The actuator in the shape of a hydraulic cylinder can be a cylinder comprising a piston 14 and a piston shaft 15, where the piston 14 delimit two fluid filled chambers in the cylinder. The adjustment between an open and a closed position is made by increasing or decreasing the pressure in the fluid filled chambers by means of a hydraulic valve 13. In one or both chambers, a compression spring 16 can be arranged. The spring 16 operates as a safety feature and acts on the piston 14 if something should break and the internal pressure in the chambers should disappear.

The locking arrangement 9 comprises as least one, in relation to the frame, moveable locking part 9*a*, 9*b*, with a first distal end 9*ay*, 9*by* and one second proximal end 9*ai*, 9*bi*. The distal end 9*ay*, 9*by* can be protruded out through an opening in the frame 4 and lock one of the two locking pins 3*b* of the tool in the frame 4. Thus, the locking arrangement 9 can be said to have two positions; one first position (shown as an open position in FIGS. 2*a* and 2*b*) when the at least one locking part 9*a*, 9*b* is inserted in the frame and a second position (shown as a locked position in FIGS. 3*a* and 3*b*) when the at least one locking part 9*a*, 9*b* protrudes from the frame 4 and delimits the second cutout 6 in a direction parallel to the first cutout 5. In such a way the second attachment pin 3*b* of the tool is safely locked in the quick coupler 1, i.e. the attachment pin 3*b* is prevented from being vertically pulled out from the second cutout 6. The at least one locking part 9*a*, 9*b* can also have a chamfer in its first distal end 9*ay*, 9*by* which is adapted after the shape of the one of the attachment pins 3*a*, 3*b* of the tool adapted to cooperate with the second cutout 6.

According to the embodiment shown in FIGS. 2 and 3, the locking arrangement 9 comprises two cylindrically shaped and elongated locking parts 9*a*, 9*b* which are connected with each other by a yoke 9*c*. The locking parts 9*a*, 9*b* are arranged to run through a respective opening 11 in the frame 4. Each opening 11 can be sealed by a sealing and/or a scraper (not shown) in order to seal off the space in the frame 4 where the actuator 8 is placed from dirt and moisture.

Figure 4:
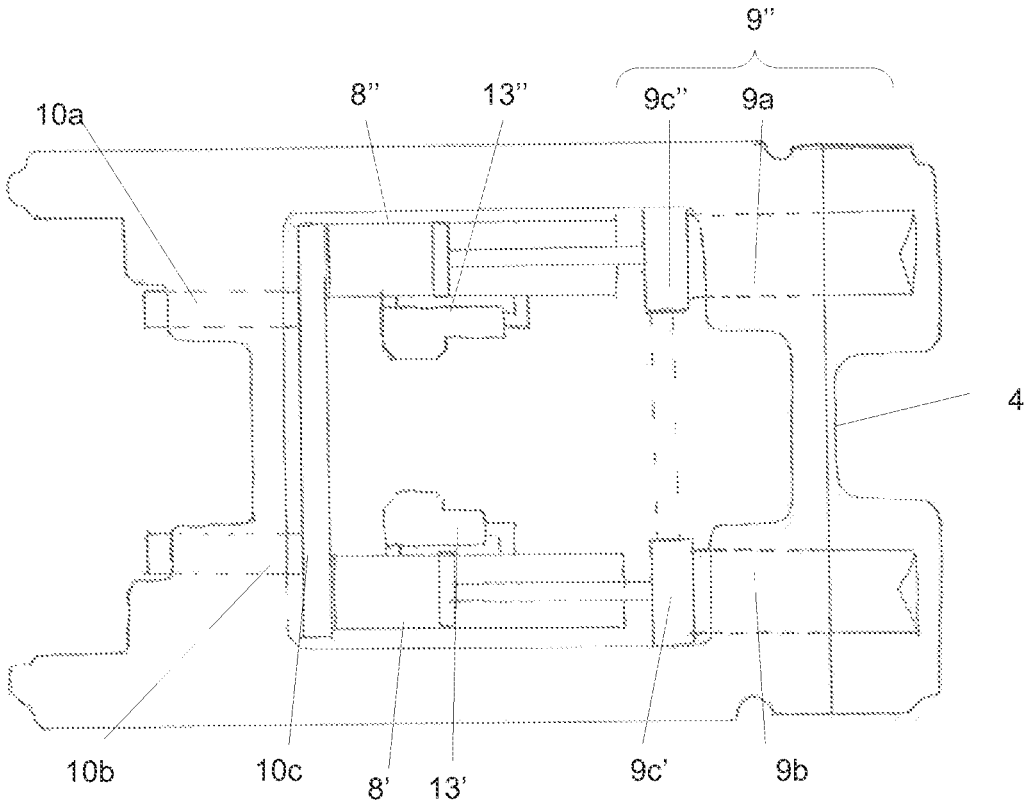
FIG. 4 shows a second embodiment of the quick coupler.

It is also conceivable to use two or more actuators 8', 8", see FIG. 4. These actuators can be separate or connected and act directly or indirectly on respective locking part 9*a*, 9*b*. The actuators 8', 8" can be controlled individually by separate or common hydraulic valves 13', 13" or by electrical or mechanical arrangements. It is also possible to mechanically connect the actuators by a yoke 10*c*.

The lock indication device 10 comprises at least one elongated indication part 10*a*, 10*b* with a first distal end 10*ay*, 10*by* and a second proximal end 10*ai*, 10*bi*. The at least one indication part 10*a*, 10*b* is arranged to run in an opening 12 in the frame 4 so that it in a first position is inserted in the frame 4 and in second position protrudes from the frame 4 and becomes visible from outside the frame 4. In order to make it even easier for the observer, which can be the driver or other person, to see the indication part, the distal end 10*ay*, 10*by* of the at least one indication part 10*a*, 10*b* can have a color different from the color of the frame 4. If a fluorescent color is used the indication part is also visible during darker conditions.

In the embodiment according to FIGS. 2 and 3 the indication parts are two cylinders 10*a*, 10*b* connected with a connection part 10*c*. The cylinders 10*a*, 10*b* are arranged to run parallel in two openings 12 in the frame 4. If two cylinders are used to indicate if the lock is locked or open a better/more secure display is achieved, especially when the observer is standing in a direction across from the side or directly under the tool and quick coupler.

The two openings 12 in the frame 4 can comprise a seal and/or a scraper (not shown) in order to further seal off the space inside the frame 4. Of course it is also possible to enclose the entire space inside the frame 4, for example by attaching a lid (not disclosed) to the frame base 4*c*. If the actuator 8 is placed in a sealed space, the life of the actuator is increased.

The invention claimed is:

1. A quick coupler for attaching a tool, comprising an attachment bracket with two parallel attachment pins, to an earth moving vehicle, wherein the quick coupler comprises:

a frame with a first cutout with an essentially horizontal extension direction and a second cutout with an essentially vertical extension direction so that the cutouts are arranged substantially perpendicular to each other, where each respective cutout is adapted to cooperate with a respective attachment pin of the tool, at least one locking arrangement, moveable in relation to the frame, and adapted to delimit the second cutout in a direction parallel to the first cutout, whereby one of the attachment pins of the tool is locked up in the second cutout, at least one actuator, arranged in the frame and adapted to move the locking arrangement in relation to the frame between a first open position and a second locked position in a direction substantially parallel to the extension direction of the first cutout, and a lock indication device which visually indicates if the locking part is in the first or second position, wherein the at least one actuator is attached between the locking arrangement and the lock indication device and is arranged to linearly move the locking arrangement and the lock indication device in relation to the frame in opposite directions, substantially parallel to the extension direction of the first cutout so that the lock indication device visually indicates when the locking arrangement is in the second locked position by a protrusion of the lock indication device from the frame which therefore makes it visible from outside the frame, wherein the lock indication device comprises at least one elongated indication part with a first distal end and a second proximal end, where the at least one indication part is arranged to linearly run in an opening in the frame so that in the first position it is inserted in the frame and in the second position it protrudes from the frame and becomes visible from outside the frame.

2. Quick coupler according to claim 1, wherein the locking arrangement and the lock indication device are arranged to be moved substantially simultaneously.

3. Quick coupler according to claim 1, wherein the first distal end of the at least one indication part has a color differing from the color of the frame.

4. Quick coupler according to claim 1, wherein two cylindrical indication parts, connected with each other, are arranged to run parallel in two openings in the frame.

5. Quick coupler according to claim 1, wherein the locking arrangement comprises at least one elongated locking part with a first distal end and a second proximal end, wherein the at least one elongated locking part is arranged to linearly run in an opening in the frame so that in the first position it is inserted in the frame and in the second position it protrudes from the frame to delimit the second cutout in a direction parallel with the first cutout.

6. Quick coupler according to claim 5, wherein the at least one elongated locking part has the shape of a cylinder.

7. Quick coupler according to claim 5, wherein two cylindrical locking parts are arranged to run parallel in two openings in the frame.

8. Quick coupler according to claim 5, wherein the at least one elongated locking part has a chamfer in its first distal end which is adapted to the shape of the attachment pin of the tool which is adapted to cooperate with the second cutout.

* * * * *